US005752396A

United States Patent [19]

Schmid et al.

[11] Patent Number: 5,752,396

[45] Date of Patent: May 19, 1998

[54] THREAD CONTROL DEVICE FOR FLAT KNITTING MACHINE

[75] Inventors: Franz Schmid, Bodelshausen; Fritz Walker, Kusterdingen, both of Germany

[73] Assignee: H. Stoll GmbH & Co., Reutlingen, Germany

[21] Appl. No.: 730,334

[22] Filed: Oct. 15, 1996

[30] Foreign Application Priority Data

Oct. 14, 1995 [DE] Germany ..... 195 38 312.5

[51] Int. Cl.[6] ..... D04B 15/44; D04B 35/14

[52] U.S. Cl. ..... 66/146; 242/150

[58] Field of Search ..... 242/149, 150, 242/419.4; 226/195; 28/194; 66/158, 125 R

[56] References Cited

U.S. PATENT DOCUMENTS

| | | | |
|---|---|---|---|
| 42,672 | 5/1864 | Marks | 66/158 |
| 1,043,309 | 11/1912 | Fessmann et al. | 28/194 X |
| 2,560,577 | 7/1951 | Ivandick | 242/150 |
| 2,597,044 | 5/1952 | Warwick | 242/150 |
| 2,715,505 | 8/1955 | Atkins | 242/150 |
| 2,912,185 | 11/1959 | Vossen . | |
| 2,965,058 | 12/1960 | Herbst et al. | 242/150 X |
| 3,851,502 | 12/1974 | Hopkins . | |
| 4,526,019 | 7/1985 | Betts, et al. . | |
| 4,700,553 | 10/1987 | Goller, et al. . | |
| 4,821,199 | 4/1989 | Kuhnert | 66/146 X |
| 4,869,079 | 9/1989 | Goller et al. | 66/146 |
| 5,517,738 | 5/1996 | Wildi-weber | 242/149 X |

FOREIGN PATENT DOCUMENTS

| | | | |
|---|---|---|---|
| 1081450 | 12/1954 | France | 242/150 |
| 63-3028933 | 2/1988 | Japan | 28/194 |
| 617215 | 7/1935 | United Kingdom | 28/194 |
| 617425 | 8/1935 | United Kingdom | 242/150 |
| 1056920 | 12/1964 | United Kingdom . | |

*Primary Examiner*—John J. Calvert
*Attorney, Agent, or Firm*—Michael J. Striker

[57] ABSTRACT

A thread control device for a flat knitting machine having a housing and at least one thread brake arranged on the housing, has a spring acting on the thread brake, a flat spring web supported at one side, and a slider movable in a recess of the housing and having a foot which slides on the spring web so that a free end of the flat spring changes a force of the spring which acts on the thread brake in correspondence with a position of the slider.

10 Claims, 3 Drawing Sheets

THREAD CONTROL DEVICE FOR FLAT KNITTING MACHINE

BACKGROUND OF THE INVENTION

The present invention relates to a thread control device for flat knitting machines with a housing and at least one thread brake, a knot guard and a thread break sensor arranged on the housing.

The thread control devices of the above mentioned type are usually arranged each between a yarn spool and the preprocessing region of a knitting machine. In flat knitting machines, a carrier is provided for this purpose above the needle beds, with a plurality of the control devices arranged on it. The elements of the control device are adjustable to the type and thickness of the threads as well as to the knitting pattern. It is possible to further improve the existing thread control devices for flat knitting machines of this type.

SUMMARY OF THE INVENTION

Accordingly, it is an object of the present invention to provide a thread control device which occupies only a small mounting space in the direction of its width and can be adjustable to different requirements fast and in operator-friendly manner.

In keeping with these objects and with others which will become apparent hereinafter, one feature of present invention resides, briefly stated, in a control device of the above mentioned general type in which in accordance with the present invention, a slider movable in a recess of the housing is provided for regulation of the thread brake and its foot slides along a flat spring which is spring-biased at one side, so that the free end of the flat spring changes the force of a spring acting on the thread brake in dependence on the position of the slider.

In conventional thread control devices the thread brake is adjusted by a helical spring acting on the brake disc of the thread brake by a rotary button supported on a threaded pin so as to compress it more or less. Thereby the braking force is changed correspondingly. The threaded pin and the rotary button however project laterally relatively far beyond the housing of the control device. Thereby the mounting space of the conventional control devices is relatively great. With the adjusting mode of the thread brake in accordance with the present invention, only a minimal place is needed in the axial direction of the thread brake. The spiral spring for the thread brake as well as the spring path can be covered completely by the housing. The slider can be arranged at a small distance from the thread brake in a small region of the housing, so that as a whole a very small mounting space of the total control device is provided. Thereby a substantially greater number of control devices can be arranged one near the other on a common carrier above the needle beds of the inventive flat knitting machine than with the conventional control systems. The device moreover has no projecting elements and guarantees an unobjectionable thread running also during loop formation of the threads.

In accordance with a further advantageous feature of the present invention, the edge of the recess of the slider can be provided with a scale which corresponds to the breaking force of the thread brake. In this way the adjusted breaking force can be observed from the position of the slider.

Adjustment of the breaking force selected for a predetermined thread type end thickness as well as for a predetermined knitting pattern can be determined by a numerical value, and can be adjusted very fast during a new use of the same yarn type as well as knitting of parts with the same pattern.

The sensitivity of at least one knot guard can be adjustable by an adjusting wheel, and the adjusting wheel and/or the neighboring housing region can be provided with a scale corresponding to the detectable knot size. With the scale, the adjusted sensitivity of the knot guard is recognizable.

Also, the clamping force of a thread recovery clamping arm, which is preferably arranged exchangeably on the housing, can be adjusted by an adjusting wheel, and the adjusting wheel and/or the neighboring housing region can be provided with a scale corresponding to the clamping force. As a result, the same advantages as in the case of the scale for the recess of the slider and the adjusting wheel for the knot guard are provided. The exchangeable arrangement of the thread recovery clamping arm makes possible a fast conversion of the machine to another pitch of the needle bed.

The flexibility of the knitting machine can be increased by providing thread guiding elements on the front end side of the housing, with an adjustable distance of the thread guiding elements from the housing, in accordance with a further feature of the present invention.

Further advantages with respect to the operator-friendly construction are obtained by providing the slider and the adjusting wheels with a contrast paint with respect to the housing. Thereby an operator can easily recognize adjusting elements which are important for him as a separate unit. Also, well observable control lights can be provided on the front end side of the housing for facilitating the operation of the knitting machine. In this way the associated control device is easily detectable after noticing a thread breakage.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
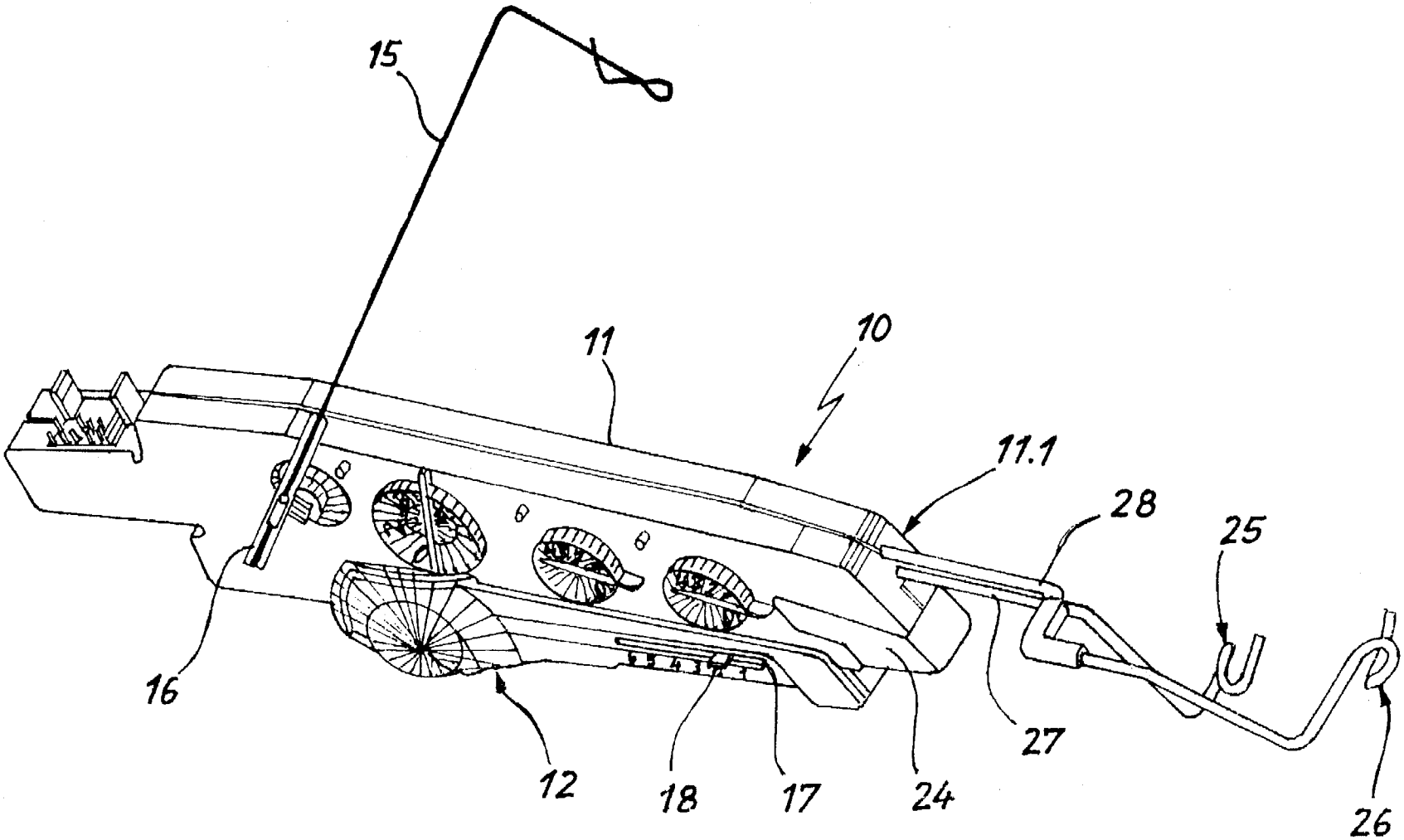
FIG. 1 is a perspective view showing a control device in accordance with the present invention.
Figure 3:
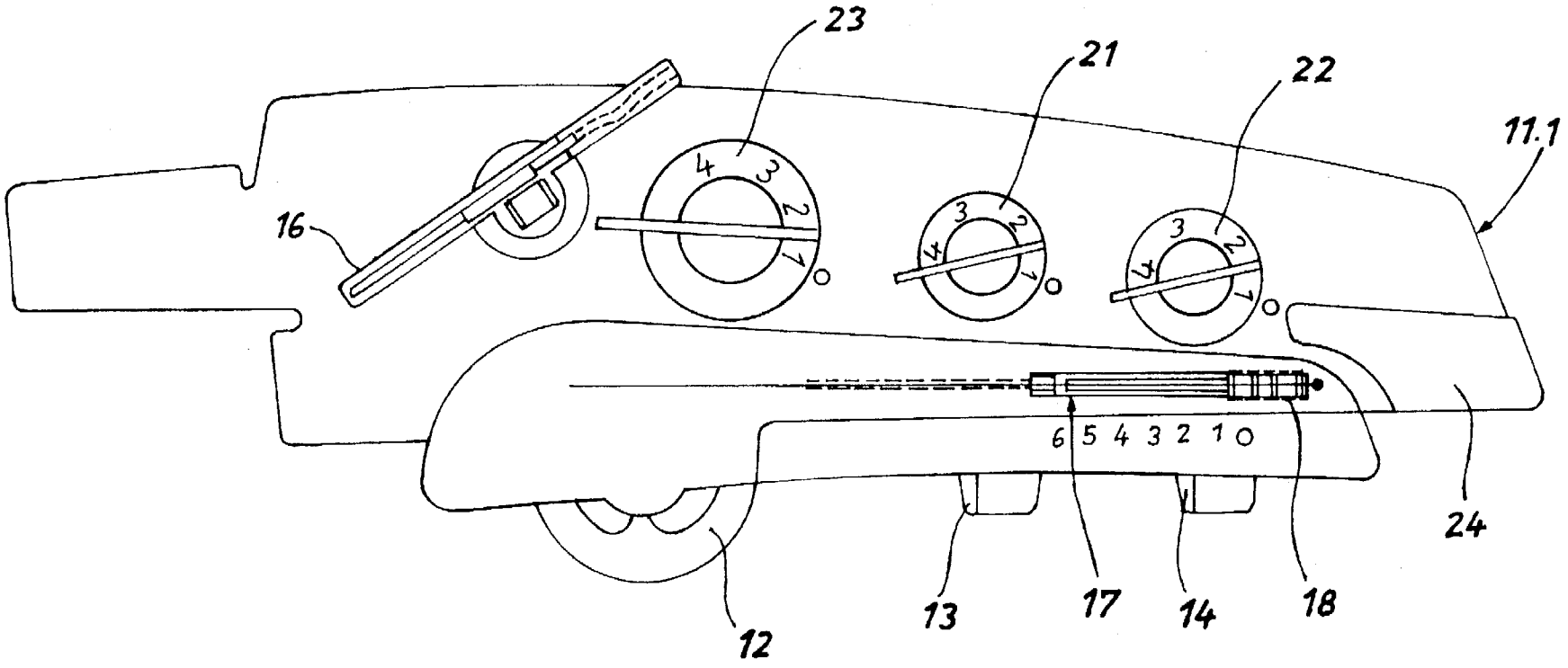
FIG. 3 is a schematic side view of the control device of FIG. 1.

A control device in accordance with the present invention is identified as a whole in FIG. 1 with reference numeral 10. It has a small, longitudinally extending housing 11 with a thread brake 12 arranged on its lower side. Also, two knot guard 13 and 14 are provided on the lower side of the housing as shown in FIG. 3. A thread recovery clamping arm 15 is releasably mounted in a holder 16 on the side of the mounting 11. The clamping arm 15 is also supported longitudinally displaceably in the holder 16.

The thread brake 12 can be regulated by a slider 18 which is movable in a recess 17 of the housing 11. The operational procedure of the regulation is illustrated in detail in FIG. 2. A foot 18.1 of the slider 18 slides along a flat spring 19. One end 19.1 of the flat spring 19 is fixedly supported in the housing. The other free end 19.2 of the flat spring 19 acts on the end of a helical spring 20. The helical spring 20 acts on one of the two brake discs 12.1, 12.2 of the thread brake 12. Depending on the position of the slider 18, the free end 19.2 compresses the helical spring 20 more or less, and thereby a smaller or greater force acts on the breaking disc 21.

Figure 2:
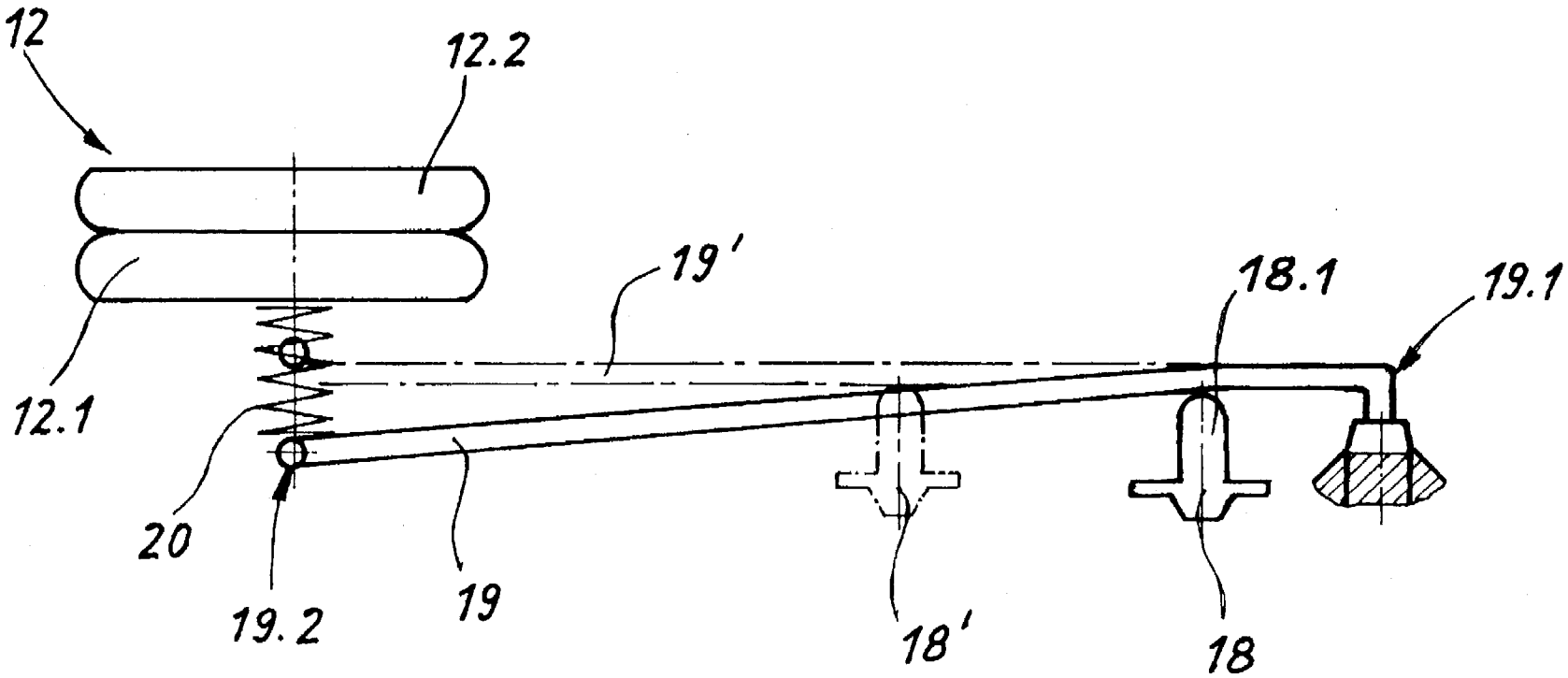
FIG. 2 is a detailed view of an actuating mechanism for a thread brake of the inventive control device of FIG. 1.

FIG. 2 shows in solid lines a position of the slider 18 in which the spring 20 is relaxed and thereby the thread brake 12 applies a minimal braking force to a thread. In the position 18' of the slider 18 shown in broken lines, the flat spring is moved to the position 19' identified with broken lines and the helical spring 20 is strongly compressed. Thereby the breaking force of the thread brake 12 is correspondingly increased. With this type of regulation of the thread brake 12, substantially only the mounting space for the helical spring 20 is required in the axial direction of the breaking discs 12.1, 12.2 of the thread brake 12. Rotary buttons which in conventional thread brakes were used for adjustment of the braking force and occupied a lot of mounting space in this direction are dispensed with. Thereby the total width of the housing 11 of the control device 10 in accordance with the present invention is substantially small and more control devices 10 can be arranged near one another on a knitting machine than before. Alternatively, the same number of the devices can be arranged with greater distances from one another, which facilitates the operation of the devices. Also, the absence of the projecting parts increases the safety of the thread run.

The sensitivity of both knot guards 13 and 14 as well as the clamping force of the thread recovery clamping arm 15 are also regulatable by adjusting wheels 21, 22, and 23. All adjusting wheels 21, 22, and 23 and also the recess 17 are provided at their edge with a scale corresponding to the sensitivities and clamping or breaking forces. Therefore an optimal adjustment determined for a predetermined application is easily readable, can be identified, and can be easily adjusted again in similar applications.

A further increase of the operation-friendly nature of the inventive knitting machine is performed by a control light 24 in the lower half of the front end side 11.1 of the housing 11. Moreover, two thread guiding elements 25 and 26 are arranged on beams 27 and 28 on the front end side 11.1 of the housing 11 as shown in FIG. 1. They are insertable in the housing 11 for different distances. Thereby the distance of the thread guiding elements 25 and 26 from the end side 11.1 of the housing 11 is changeable in a simple manner.

It will be understood that each of the elements described above, or two or more together, may also find a useful application in other types of constructions differeng from the types described above.

While the invention has been illustrated and described as embodied in thread control device for flat knitting machine, it is not intended to be limited to the details shown, since various modifications and structural changes may be made without departing in any way from the spirit of the present invention.

Without further analysis, the foregoing will so fully reveal the gist of the prsent invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread control device for a flat knitting machine having a housing and at least one thread brake arranged on the housing, the thread control device comprising a spring acting on the thread brake; a brake; a flat spring supported at one side; and a slider movable in a recess of the housing and having a foot which slides on said flat spring so that a free end of said spring web flat changes a force of said spring which acts on the thread brake in correspondence with a position of said slider, said free end of said flat spring acting on an end of said spring which acts on the thread brake.

2. A thread control device as defined in claim 1; and further comprising a scale formed in correspondence with a breaking force of the thread brake and arrangeable on an edge of the recess.

3. A thread control device as defined 1; and further comprising a control light located on a front end side of the housing and easily visible from below.

4. A thread control device for a flat knitting machine having a housing and at least one thread brake arranged on the housing, the thread control device comprising a spring action on the thread brake; a flat spring supported at one side; and a slider movable in a recesess of the housing and having a foot which slides on said flat spring so that a free end of said flat spring changes a force of said spring which acts on the thread brake in correspondence which a position of said slider, said free end of said flat spring acting on an end of said spring which acts on the thread brake; and a thread recovery clamping arm which is exchangeably arrangeable on the housing.

5. A thread control device as defined in claim 4; and further comprising a holder, said thread recovery clamping arm being supported longitudinally displaceably in said holder on the housing.

6. A thread control device as defined in claim 4; and further comprising means for adjusting a clamping force of said thread recovery clamping arm and including at least one adjusting wheel, and a scale corresponding to a clamping force and provided on at least one of said adjusting wheel and a neighboring housing region.

7. A thread control device for a flat knitting machine having a housing and at least one thread brake arranged on the housing, the thread control device comprising a spring action on the thread brake; a flat spring supported at one side; and a slider movable in a recess of the housing and having a foot which slides on said flat spring so that a free end of said flat spring changes a force of said spring which acts on the thread brake in correspondence with a position of said slider, said free end of said flat spring acting on an end of said spring which acts on the thread brake; a knot guard; a means for adjusting a sensitivity of a knot guard and including an adjusting wheel, marking means arrangeable on one of said adjusting wheel and a neighboring housing region, said adjusting wheel having a scale corresponding to a knot size to be detected.

8. A thread control device for a flat knitting machine having a housing and at least one thread brake arranged on the housing, the thread control device comprising a spring action on the thread brake; a flat spring supported at one side; and a slider movable in a recess of the housing and having a foot which slides on said flat spring so that a free end of said flat spring changes a force of said spring which acts on the thread brake in correspondence with a position of said slider, said free end of said flat spring acting on an end of said spring which acts on the thread brake, said slider being provided with a color which is different from a color of the housing.

9. A thread control device for a flat knitting machine having a housing and at least one thread brake arranged on the housing, the thread control device comprising a spring action on the thread brake; a flat spring supported at one side; and a slider movable in a recess of the housing and having a foot which slides on said flat spring so that a free end of said flat spring changes a force of said spring which acts on the thread brake in correspondence with a position of said slider, said free end of said flat spring acting on an end of said spring which acts on the thread brake; and means for adjusting a sensitivity of a knot guard arranged on the housing and including an adjusting wheel, marks provided on at least one of said adjusting wheel and a neighboring housing region, and a scale provided on said adjusting wheel and corresponding to a knot size to be detected; a threaded recovery clamping arm exchangeably arrangeable on the housing and provided with means for adjusting a clamping force of said thread recovery clamping arm, said means including at least one adjusting wheel and a scale corresponding to a clamping force and provided in at least one of said adjusting wheel and a neighboring housing region, said adjusting wheel having a color which is different from a color of the housing.

10. A thread control device for a flat knitting machine having a housing and at least one thread brake arranged on the housing, the thread control device comprising a spring action on the thread brake; a flat spring supported at one side; and a slider movable in a recess of the housing and having a foot which slides on said flat spring so that a free end of said flat spring changes a force of said spring which acts on the thread brake in correspondence with a position of said slider, said free end of said flat spring acting on an end of said spring which acts on the thread brake; and threaded guiding elements arrangeable on a front end side of the housing with an adjustable distance from the housing.

* * * * *